US011724840B2

(12) United States Patent
Watanabe et al.

(10) Patent No.: US 11,724,840 B2
(45) Date of Patent: Aug. 15, 2023

(54) BLISTER PACKING MACHINE AND BLISTER PACK MANUFACTURING METHOD

(71) Applicant: CKD CORPORATION, Aichi (JP)

(72) Inventors: Satoshi Watanabe, Aichi (JP); Seiji Kawai, Aichi (JP)

(73) Assignee: CKD CORPORATION, Aichi (JP)

( * ) Notice: Subject to any disclaimer, the term of this patent is extended or adjusted under 35 U.S.C. 154(b) by 57 days.

(21) Appl. No.: 17/576,043

(22) Filed: Jan. 14, 2022

(65) Prior Publication Data

US 2022/0135262 A1 May 5, 2022

Related U.S. Application Data

(63) Continuation of application No. PCT/JP2020/024314, filed on Jun. 22, 2020.

(30) Foreign Application Priority Data

Aug. 8, 2019 (JP) ..... 2019-145948

(51) Int. Cl.
*B65B 9/04* (2006.01)
*B65B 47/02* (2006.01)
(Continued)

(52) U.S. Cl.
CPC ..... *B65B 9/04* (2013.01); *B65B 47/02* (2013.01); *B65B 47/08* (2013.01); *B65B 61/065* (2013.01)

(58) Field of Classification Search
CPC ..... B65B 7/164; B65B 9/04; B65B 47/02; B65B 47/08; B65B 61/065
(Continued)

(56) References Cited

U.S. PATENT DOCUMENTS 3,129,545 A * 4/1964 Sloan et al. ..... B65B 47/10 53/559
3,673,760 A * 7/1972 Canamero et al. ..... B65B 9/042 53/559
(Continued)

FOREIGN PATENT DOCUMENTS

JP 53033560 U * 3/1978
JP S53-033560 A 3/1978
(Continued)

OTHER PUBLICATIONS

International Preliminary Report on Patentability issued in corresponding International Application No. PCT/JP2020/024314 dated Feb. 8, 2022, with translation (11 pages).
(Continued)

*Primary Examiner* — Stephen F. Gerrity
(74) *Attorney, Agent, or Firm* — Osha Bergman Watanabe & Burton LLP

(57) ABSTRACT

A blister packing machine includes: a conveyor that conveys a belt-like container film having a pocket portion forming area and an expected mounting part; a preheating device that preheats the container film conveyed by the conveyor; a pocket portion forming device that forms a pocket portion in the container film softened by the preheating device; and a tension applier that applies a tension along a width direction of the container film to at least the pocket portion forming area. The pocket portion forming device forms the pocket portion while the tension applier applies the tension to the container film, the container film has an edge area between an edge in the width direction and the expected mounting part, and the tension applier includes a projection that applies the tension to the container film by pressing the edge area to form a protruding portion in the container film.

13 Claims, 11 Drawing Sheets

(51) Int. Cl.
*B65B 47/08* (2006.01)
*B65B 61/06* (2006.01)

(58) Field of Classification Search
USPC ..... 53/453, 559
See application file for complete search history.

(56) References Cited

U.S. PATENT DOCUMENTS 4,134,246 A * 1/1979 Michels ..... B65B 11/12 53/559
4,489,537 A * 12/1984 Gordon ..... B65B 7/164 53/511
5,010,714 A * 4/1991 Medwed et al. ..... B29C 43/10 53/453
5,331,791 A * 7/1994 Fux et al. ..... B65B 61/18 53/373.7

FOREIGN PATENT DOCUMENTS

JP H09-025345 A 1/1997
JP H09-142423 A 6/1997
JP 2019-026365 A 2/2019
WO 2015/072500 A1 5/2015

OTHER PUBLICATIONS

International Search Report issued in corresponding International Application No. PCT/JP2020/024314, dated Aug. 25, 2020 (5 pages).
Written Opinion issued in corresponding International Application No. PCT/JP2020/024314, dated Aug. 25, 2020) (3 pages).
Office Action issued in corresponding Japanese Patent Application No. 2019-145948, dated Nov. 17, 2021 (6 pages).

* cited by examiner

BLISTER PACKING MACHINE AND BLISTER PACK MANUFACTURING METHOD

BACKGROUND

Technical Field

The present disclosure relates to a blister packing machine configured to manufacture a blister pack with a predetermined content placed therein, and a blister pack manufacturing method.

Description of Related Art

A blister pack includes a container film provided with a pocket portion which any of various contents is placed in, and a cover film mounted to the container film such as to seal an opening side of the pocket portion.

The blister pack is manufactured by a blister packing machine provided with, for example, a conveying unit, a preheating unit, a pocket portion forming unit, a filling unit, a mounting unit and a punching unit (as described in, for example, Patent Literature 1). A procedure of manufacturing the blister pack conveys a container film in a belt-like form by the conveying unit (for example, a clip chain conveyor) to the preheating unit, the pocket portion forming unit, the filling unit, the mounting unit and the punching unit in this sequence and causes the respective units to sequentially process the container film by predetermined processes, so as to manufacture the blister pack. The preheating unit preheats the container film to soften the container film. The pocket portion forming unit forms a pocket portion in the softened container film by, for example, a pressure forming method. The filling unit fills the pocket portion thus formed with a content. The mounting unit mounts a cover film in a belt-like form to the container film, so as to seal an opening side of the pocket portion filled with the content. The punching unit punches a blister film obtained by mounting the cover film to the container film. A blister pack is punched out from the blister film.

A product with a sealed content may be subjected to retort sterilization (pressurized heating) for the purpose of sterilization and long-term preservation of the content. A procedure of retort sterilization places the product in a retort oven and heats the product at a high temperature of not lower than 100° C. under a pressurized condition. The blister pack may be subjected to such retort sterilization in the case where the content of the blister pack is a food item or the like.

PATENT LITERATURE

Patent Literature 1: JP H09-142423A

Heat treatment such as retort sterilization of the blister pack is, however, likely to cause shrinkage deformation in the blister pack or especially in the container film by heating in the course of heat treatment. With a view to suppressing shrinkage deformation, one possible measure sets the preheating temperature of the container film by the preheating unit to a relatively high temperature (for example, a temperature equivalent to a melting point of the container film or a higher temperature than the melting point). The high preheating temperature of the container film is, however, likely to cause the container film after preheating to significantly sag (slack) by its own weight. The significant sag of the container film is likely to cause a defect in the course of formation of the pocket portion, for example, to cause wrinkles to arise in the pocket portion or in an expected mounting part of the container film where the cover film is to be mounted to. The wrinkles are likely to reduce the quality, for example, deterioration of the appearance quality or reduction of the sealing property in the pocket portion.

SUMMARY

One or more embodiments of the present disclosure provide a blister packing machine and a blister pack manufacturing method configured to manufacture a blister pack that is subjected to heat treatment such as retort sterilization after manufacture, and more specifically to provide a blister packing machine and a blister pack manufacturing method that more reliably prevent defects, such as wrinkles arising due to a sag of a container film.

The following describes each of various aspects provided adequately to deal with the issues described above. Functions and advantageous effects that are characteristic of each of the aspects are also described as appropriate.

Aspect 1: There is provided a blister packing machine used to manufacture a blister pack configured such that a content is placed in a pocket portion formed in a container film and that a cover film is mounted to the container film such as to close the pocket portion. The blister packing machine comprises a conveying unit (i.e., a conveyor) configured to convey the container film in a belt-like form; a preheating unit (i.e., a preheating device) configured to preheat the container film that is conveyed; a pocket portion forming unit (i.e., a pocket portion forming device) configured to form the pocket portion in the container film that is softened by the preheating unit; and a tension applying portion (i.e., a tension applier) configured to apply a tension along a width direction of the container film to at least a pocket portion forming area of the container film where the pocket portion is to be formed, wherein the pocket portion forming unit forms the pocket portion in such a state that the tension is applied to the container film by the tension applying portion.

The configuration of Aspect 1 causes the pocket portion to be formed in such a state that the tension along the width direction of the container film is applied to at least the pocket portion forming area of the container film where the pocket portion is to be formed by the tension applying portion. "Applying the tension" includes applying a tensile force in a direction of stretching the container film in the width direction. The above configuration of applying the tension to the container film enables the pocket portion to be formed, while stretching the container film in the width direction thereof to effectively suppress the container film from sagging, even when a preheating temperature of the container film is a high temperature (for example, a temperature equivalent to a melting point of the container film or a higher temperature than the melting point) for the purpose of heat treatment such as retort sterilization. This more reliably prevents defects, such as, wrinkles arising in the pocket portion or in an expected mounting part of the container film where the cover film is to be mounted to, in the course of forming the pocket portion.

Aspect 2. In the blister packing machine described in Aspect 1, the container film in the belt-like form may have an edge area located between an edge in the width direction and an expected mounting part where the cover film is to be mounted to, and the tension applying portion may comprise a protruding portion forming element (i.e., a projection) configured to press the edge area such as to protrude and deform the edge area and form a protruding portion in the container film, so as to apply the tension to the container film.

In the configuration of Aspect 2, the protruding portion forming element of the tension applying portion presses and deforms the edge area of the container film to form the protruding portion and thereby stably apply the tension to the container film. Accordingly, this relatively easily provides the configuration of stably applying the tension to the container film. As a result, this achieves simplification and downsizing of the apparatus and reduction of the cost involved in manufacture and maintenance of the apparatus.

Aspect 3. The blister packing machine described in Aspect 2 may further comprise holding guides placed on respective sides of and adjacent to the protruding portion forming element along the width direction and configured to hold an opposite surface of the container film that is opposite to a pressed surface of the container film pressed by the protruding portion forming element in a process of pressing the edge area by the protruding portion forming element.

In the configuration of Aspect 3, when the protruding portion forming element presses the edge area, the holding guides hold adjacent parts of the container film that are adjacent to a pressed part of the container film pressed by the protruding portion forming element, so as to prevent the adjacent parts from being moved with the motion of the protruding portion forming element. This enables the shape of the protruding portion that is to be formed, to be effectively reformed along the surface configuration of the protruding portion forming element and enables the protruding portion to be more stably kept in a fixed shape in a subsequent process. As a result, this reliably prevents the occurrence of a defect caused by the unstable shape of the protruding portion (for example, a variation in the positions of the pocket portion along the width direction or interference of the protruding portion in a subsequent process).

Aspect 4. In the blister packing machine described in Aspect 3, the pocket portion forming unit may comprise a lower mold that is configured to be vertically movable and an upper mold placed above the lower mold, the protruding portion forming element may be provided on the lower mold, and the holding guides may be provided on the upper mold.

The configuration of Aspect 4 suppresses an increase in the total number of components constituting the blister packing machine, while providing the protruding portion forming element and the holding guides. The container film is pressed by the protruding portion forming element simply by moving the lower mold. This configuration does not need to provide any driving source for operating the protruding portion forming element, separately from a driving source for operating the lower mold.

Aspect 5. The blister packing machine described in any of Aspects 2 to 4 may further comprise a processing unit (i.e., a processing device) configured to process the container film with the pocket portion formed therein or a blister film in a belt-like form, which is obtained by mounting the cover film in a belt-like form to the container film, by predetermined processing; and a positioning guide configured to utilize the protruding portion to position the container film or the blister film along a width direction thereof, during the predetermined processing of the container film or the blister film by the processing unit.

In the case where the protruding portion is formed for application of the tension like the configuration of Aspect 2 or the like, the protruding portion is likely to be bent to be expanded or contracted along the width direction and is thereby likely to swing or shake the container film or the blister film. Such a swing or shake may cause detects in various processes, for example, a process of filling the pocket portion with the content or mounting the cover film to the container film.

The configuration of Aspect 5, on the other hand, effectively utilizes the protruding portion formed for application of the tension to achieve positioning by the positioning guide. This configuration enables the container film or the blister film that is accurately positioned in the width direction thereof to be processed. Accordingly, this enables the container film or the blister film to be processed more appropriately.

The processing unit may be, for example, a filling unit configured to fill the pocket portion with the content, a mounting unit configured to mount the cover film to the container film, a stamping unit configured to form a stamp in the blister film, a cutting part forming unit configured to form a cutting part, such as a perforation or a slit, in the blister pack, so as to separate the blister pack, or a punching unit configured to punch out a blister pack from the blister film.

A positioning technique employed by the positioning guide that utilizes the protruding portion to position the container film or the like may, for example, form the positioning guide in a convex shape and place the positioning guide in the protruding portion or may form the positioning guide in a concave shape and place the protruding portion in the positioning guide.

Aspect 6. In the blister packing machine described in any of Aspects 1 to 5, the container film in the belt-like form may have a plurality of the pocket portions formed along the width direction.

The configuration of Aspect 6 uses a wide container film that allows a plurality of the pocket portions to be formed along the width direction. This enables a plurality of the pocket portions to be formed simultaneously and thereby enhances the production efficiency.

In the case of using the wide container film that enables a plurality of the pocket portions to be formed along the width direction, on the other hand, the container film is more likely to significantly sag by preheating. Employing the configuration of Aspect 1 or the like, however, suppresses the container film from sagging. Accordingly, even in the case of using a wide container film, this configuration more reliably prevents the occurrence of a trouble caused by a sag of the container film. In other words, the configuration of Aspect 1 or the like is especially effective in the case of using the wide container film that enables a plurality of the pocket portions to be formed along the width direction.

Aspect 7. There is provided a blister pack manufacturing method configured such that a content is placed in a pocket portion formed in a container film and that a cover film is mounted to the container film such as to close the pocket portion. The blister pack manufacturing method comprises: a conveying process of conveying the container film in a belt-like form; a preheating process of preheating the container film that is conveyed; a pocket portion forming process of forming the pocket portion in the container film that is softened in the preheating process; and a tension applying process of applying a tension along a width direction of the container film to at least a pocket portion forming area of the container film where the pocket portion is to be formed, wherein the pocket portion forming process is performed in such a state that the tension is applied to the container film by the tension applying process.

The configuration of Aspect 7 has similar functions and advantageous effects to those of Aspect 1 described above.

Aspect 8. In the blister pack manufacturing method described in Aspect 7, the container film in the belt-like form may have an edge area located between an edge in the width direction and an expected mounting part where the cover film is to be mounted to, and the tension applying process may press the edge area to protrude the edge area and form a protruding portion in the container film, so as to apply the tension to the container film.

The configuration of Aspect 8 has similar functions and advantageous effects to those of Aspect 2 described above.

DETAILED DESCRIPTION OF EMBODIMENTS

The following describes embodiments with reference to drawings. The configuration of a blister pack manufactured by a blister packing machine is described first.

Figure 1:
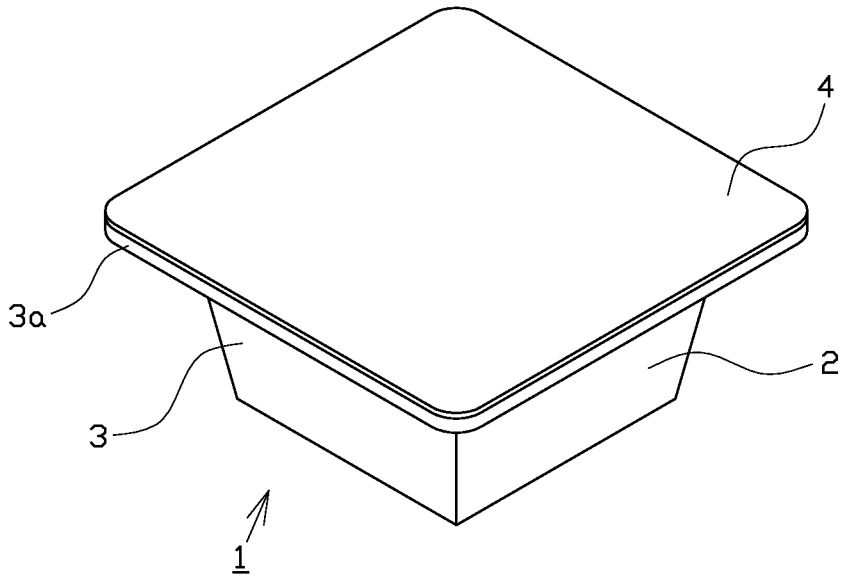
FIG. 1 is a perspective view illustrating a blister pack.
Figure 2:
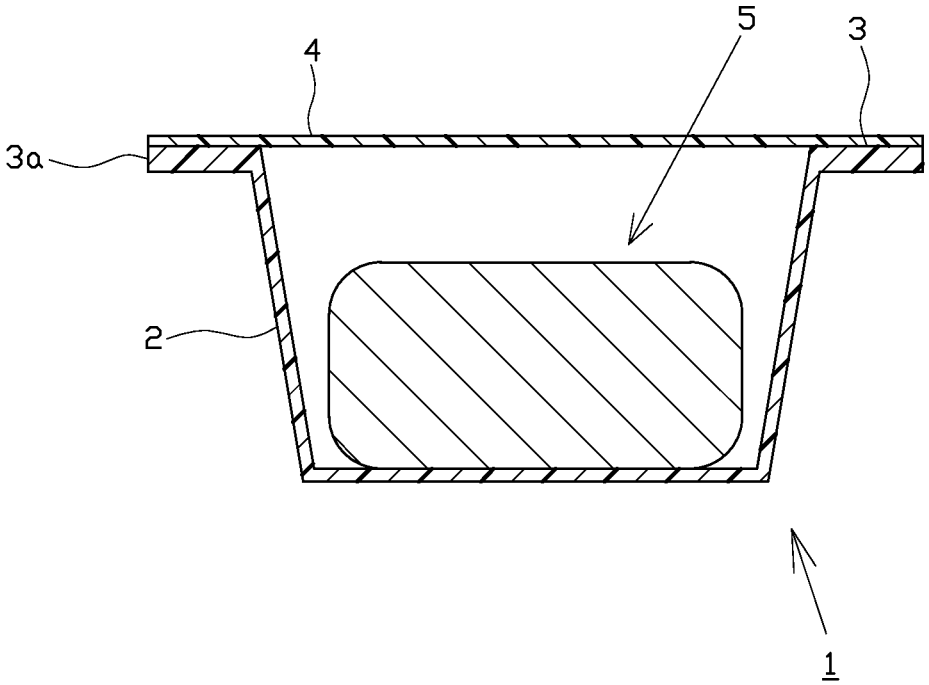
FIG. 2 is a sectional view illustrating the blister pack.

As shown in FIG. 1 and FIG. 2, a blister pack 1 according to one or more embodiments includes a container film 3 having one pocket portion 2, and a cover film 4 mounted to the container film 3 such as to close the pocket portion 2. The films 3 and 4 shown in, for example, FIG. 1 are illustrated to be thicker than actual thicknesses thereof. A content 5 such as a food product or a pet food is placed in the pocket portion 2. The container film 3 and the cover film 4 practically have no gas permeability to keep the content 5 in a sealed state.

The container film 3 is made of a thermoplastic resin material, such as PP (polypropylene) or the like. The container film 3 may have a multi-layered structure made of multiple different types of thermoplastic resin materials. The container film 3 has a flange portion 3*a* formed to be extended outward from a periphery of an opening of the pocket portion 2. The cover film 4 is, on the other hand, made of a thermoplastic resin compatible with the container film 3 and is mounted to the flange portion 3*a* of the container film 3 described above. The cover film 4 may be configured by a heat-resistant thin wall member with a sealant that is applied on the surface thereof and that is made of a thermoplastic resin compatible with the container film 3.

The blister pack 1 is subjected to heat treatment such as retort sterilization with a view to sterilizing the content 5. The heat treatment of the blister pack 1 is performed by heating the blister pack 1 at a high temperature of not lower than 100° C. (for example, 120° C. or higher) under a pressurized condition.

Figure 4:
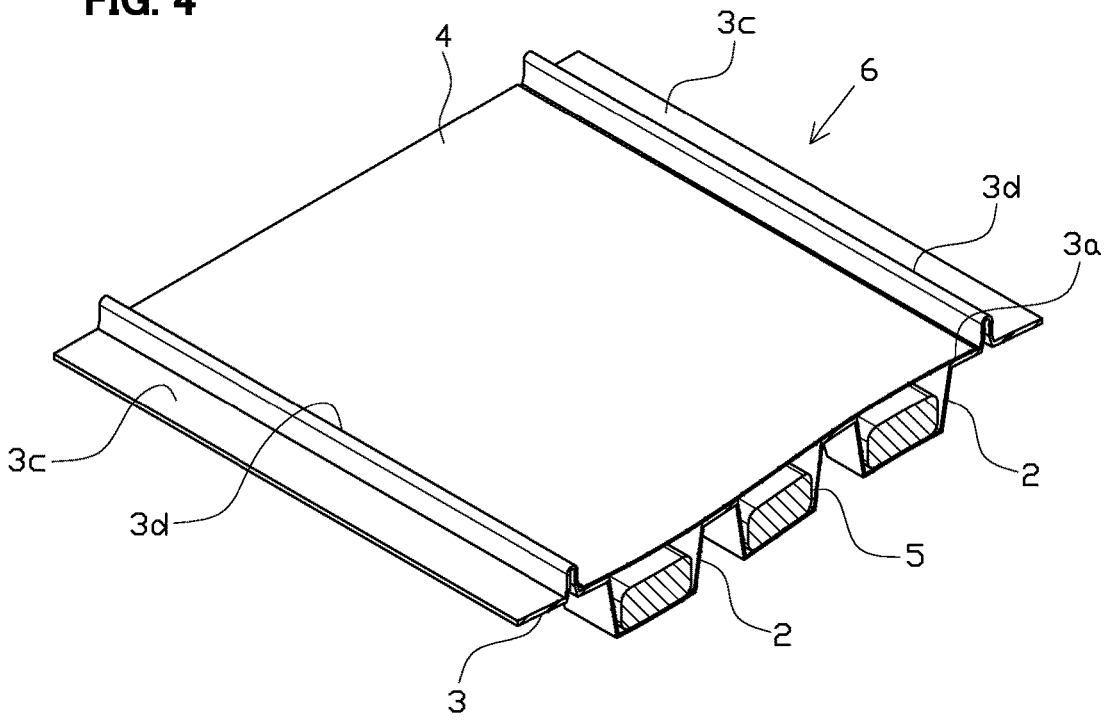
FIG. 4 is a perspective view illustrating a blister film.

Furthermore, the blister pack 1 is obtained by being punched out from a belt-like blister film 6 (as shown in FIG. 4) that is formed by mounting the cover film 4 in a belt-like form to the container film 3 in a belt-like form. The blister film 6 according to one or more embodiments is configured such that, for example, three blister packs 1 are arrayed along a width direction of the blister film 6.

The blister film 6 is configured such that the cover film 4 is mounted to part of the flange portion 3*a* of the container film 3 other than those located on respective ends in a width direction of the container film 3. As a result, the container film 3 in the belt-like form has edge areas 3*c* which are located between edges in the width direction and an expected mounting part where the cover film 4 is to be mounted to and in which the cover film 4 is not mounted to.

A protruding portion 3*d* is protruded and formed in this edge area 3*c* to be extended in a conveying direction (longitudinal direction) of the blister film 6. According to one or more embodiments, the protruding portion 3*d* is formed in each of the edge areas 3*c* located on the respective ends in the width direction of the container film 3.

The following describes the configuration of a blister packing machine 10 to manufacture the blister packs 1 described above.

Figure 3:
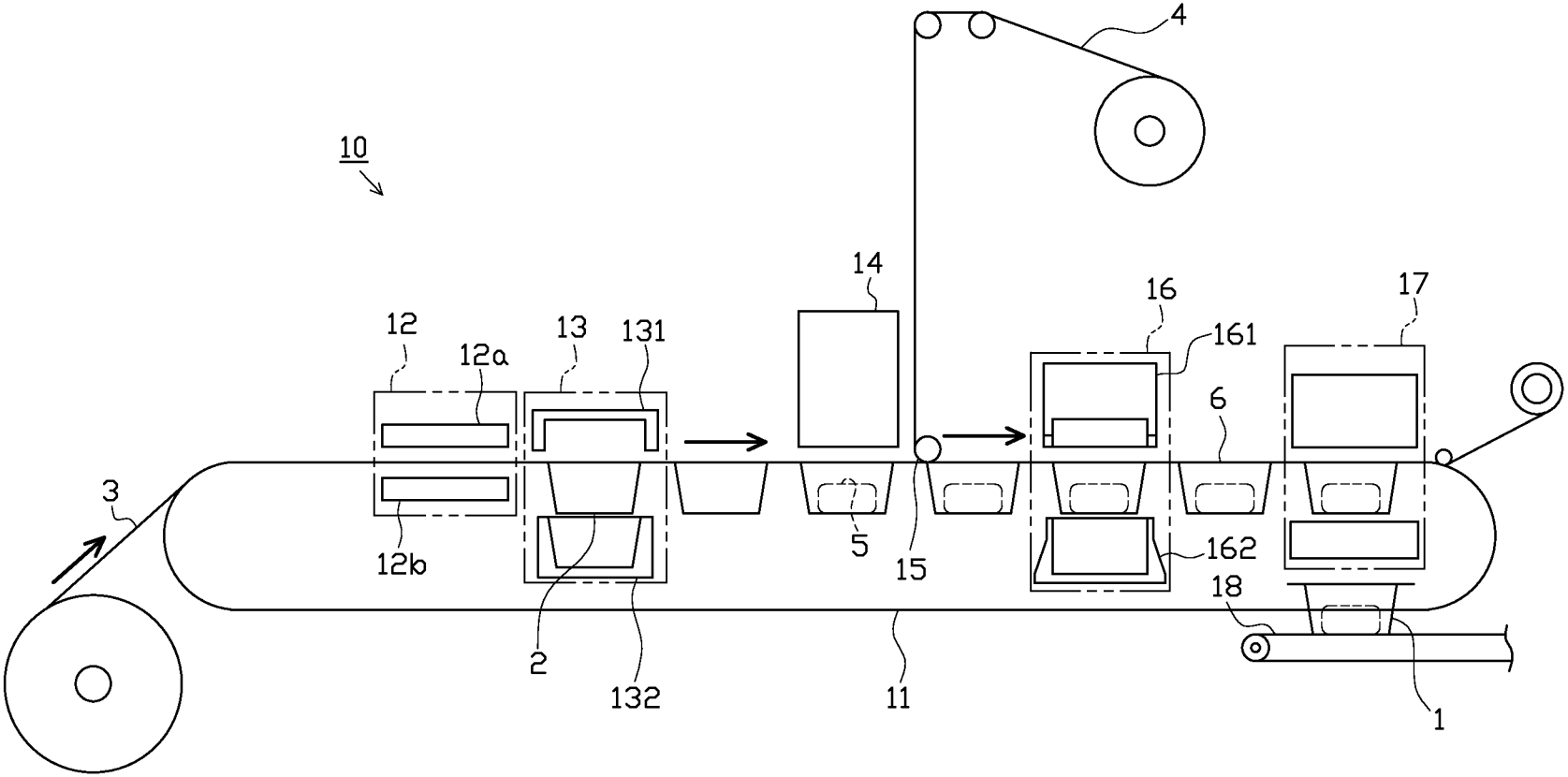
FIG. 3 is a schematic diagram illustrating the schematic configuration of a blister packing machine.

As shown in FIG. 3, the blister packing machine 10 is provided with a clip chain conveyor 11 serving as the conveying unit. The clip chain conveyor 11 serves to convey the belt-like container film 3 pulled out from a film roll to downstream intermittently. The clip chain conveyor 11 includes clip portions 11*a* (shown in, for example, FIG. 5) configured to hold the container film 3. The clip chain conveyor 11 conveys the container film 3 in the state that the clip portions 11*a* hold the respective edge areas 3*c* located on the respective ends in the width direction of the container film 3.

The belt-like container film 3 pulled out from the film roll is relatively wide and is configured to enable a plurality of (three according to one or more embodiments) pocket portions 2 to be formed along the width direction thereof. Additionally, the container film 3 is relatively thin and has a thickness of not greater than 120 μm and not less than 300 μm.

A preheating device 12 and a pocket portion forming device 13 are provided downstream of the film roll of the container film 3 to be placed in this sequence along a conveyance path of the container film 3. The "preheating device 12" configures the "preheating unit", and the "pocket portion forming device 13" configures the "pocket portion forming unit" according to one or more embodiments.

The preheating device 12 includes a first preheating unit 12*a* and a second preheating unit 12*b* that are respectively placed on an upper side and on a lower side across the container film 3 and is configured to heat at least pocket portion-forming areas of the container film 3 where the pocket portions 2 are to be formed. According to one or more embodiments, a preheating temperature of the container film 3 by the preheating device 12 is a relatively high temperature (for example, a temperature equivalent to a melting point of the container film 3 or a higher temperature than the melting point), in order to prevent shrinkage deformation of the container film 3 (especially the pocket portion 2) in the process of heat treatment such as retort sterilization of the blister packs 1. When the container film 3 is made of a single material, the "melting point of the container film 3" herein means a melting point of this single material. When the container film 3 has a multi-layered structure made of multiple different thermoplastic resin materials, the "melting point of the container film 3" herein means a melting point of at least one of these thermoplastic resin materials (excluding an adhesive layer).

The pocket portion forming device 13 includes an upper mold 131 and a lower mold 132 that are respectively placed on an upper side and on a lower side across the container film 3. The pocket portion forming device 13 causes the container film 3, which is preheated to be softened and which is placed between the upper mold 131 and the lower mold 132, to be pressed against the lower mold 132 by means of a predetermined gas (an inert gas, the air according to one or more embodiments), so as to form the pocket portions 2 in the container film 3. The pocket portion forming device 13 will be described in more detail later.

A filling device 14 serving as the filling unit is provided downstream of the pocket portion forming device 13 to fill the pocket portions 2 with the content 5. The filling device 14 opens a shutter (not shown) at predetermined time intervals, for example, in synchronism with the conveying operations of the container film 3 to place predetermined amounts of the content 5 into the pocket portions 2.

A film roll of the cover film 4 in a belt-like form is, on the other hand, wound in a roll and arranged separately from the container film 3. The cover film 4 pulled out from the film roll is guided to a receiving roller 15 provided downstream of the filling device 14. The cover film 4 guided to the receiving roller 15 is laid on the container film 3 such as to close the pocket portions 2.

A sealing device 16 serving as the mounting unit is provided downstream of the receiving roller 15. According to one or more embodiments, the "sealing device 16" configures the "processing unit". The sealing device 16 includes an upper sealing mold 161 and a lower sealing mold 162 and serves to heat the container film 3 and the cover film 4 that are placed between these respective molds 161 and 162. The sealing device 16 welds the cover film 4 to the container film 3, so as to provide the belt-like blister film 6 with the pocket portions 2 filled with the content 5. The more detailed configuration of the sealing device 16 will be described later.

A punching device 17 is provided downstream of the sealing device 16 and serves as the punching unit to punch out the units of blister packs 1 from the blister film 6. The blister packs 1 punched out from the blister film 6 are transported to a non-illustrated finished product hopper by a conveyor 18.

A non-illustrated cutting device is provided downstream of the punching device 17 to cut out scraps that remain by punching-out and that include the protruding portions 3*d*. The cut-out scraps are accumulated in a non-illustrated scrap hopper.

The pocket portion forming device 13 including the upper mold 131 and the lower mold 132 is described below in more detail.

Figure 5:
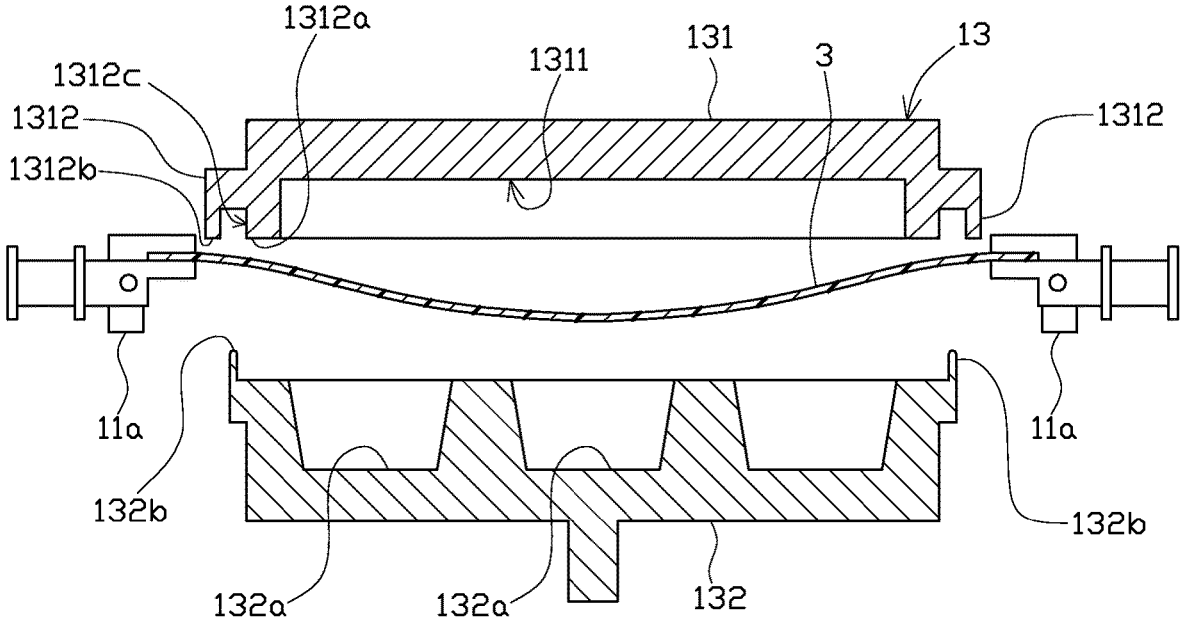
FIG. 5 is a schematic sectional view illustrating the schematic configuration of a pocket portion forming device.

As shown in FIG. 5, the upper mold 131 is is formed in a top-closed rectangular tubular shape and has an internal space 1311 that is opened downward. The predetermined gas is suppliable to the internal space 1311 by a non-illustrated gas supply device. Additionally, the upper mold 131 is continuously water-cooled by a non-illustrated cooling water circulation device. According to one or more embodiments, the upper mold 131 is placed in a stationary state (not to be movable). The upper mold 131 may, however, be configured to be vertically movable.

Furthermore, holding guides 1312 are provided on respective ends of the upper mold 131 along the width direction of the container film 3. The holding guide 1312 according to one or more embodiments includes an inner side holding element 1312*a* and an outer side holding element 1312*b*, which are opposed to each other in the width direction, and has a receiving space 1312*c* that is formed between the respective holding elements 1312*a* and 1312*b* to be open downward. The outer side holding elements 1312*b* and the inner side holding elements 1312*a* serve to hold the container film 3 in the course of pressing the container film 3 by protruding portion forming elements (i.e., projections) 132*b* described later, so as to reform the shape of the protruding portions 3*d* along the surface configuration of the protruding portion forming elements 132*b*. The receiving spaces 1312*c* serve as spaces to receive the protruding portion forming elements 132*b* when the container film 3 is pressed by the protruding portion forming elements 132*b*. The inner side holding elements 1312*a* also serve to hold the respective films 3 and 4 placed between the upper mold 131 and the lower mold 132 in the course of forming the pocket portions 2.

The lower mold 132 is configured to reciprocate in a vertical direction between an approach position to be close to the upper mold 131 and a retreat position to be away from the upper mold 131 by a non-illustrated driving unit. The lower mold 132 has a plurality of molding recesses 132*a* that correspond to the shape of the pocket portions 2 and that are arranged along the width direction of the container film 3. The lower mold 132 is also configured to be water-cooled, like the upper mold 131.

Furthermore, the protruding portion forming elements 132*b* are provided as projections on respective ends of the lower mold 132 along the width direction of the container film 3 to be protruded upward and to be extended along the conveying direction of the container film 3. According to one or more embodiments, the "protruding portion forming element 132*b*" configures the "tension applying portion". When the lower mold 132 is moved up, the protruding portion forming elements 132*b* press the edge areas 3*c* of the container film 3, so as to form the protruding portions 3*d* in the edge areas 3*c*. Pressing the edge areas 3*c* to form the protruding portions 3*d* applies the tension along the width direction of the container film 3 to at least the pocket portion forming areas of the container film 3 where the pocket portions 2 are to be formed.

The sealing device 16 including the upper sealing mold 161 and the lower sealing mold 162 is described below in more detail.

Figure 10:
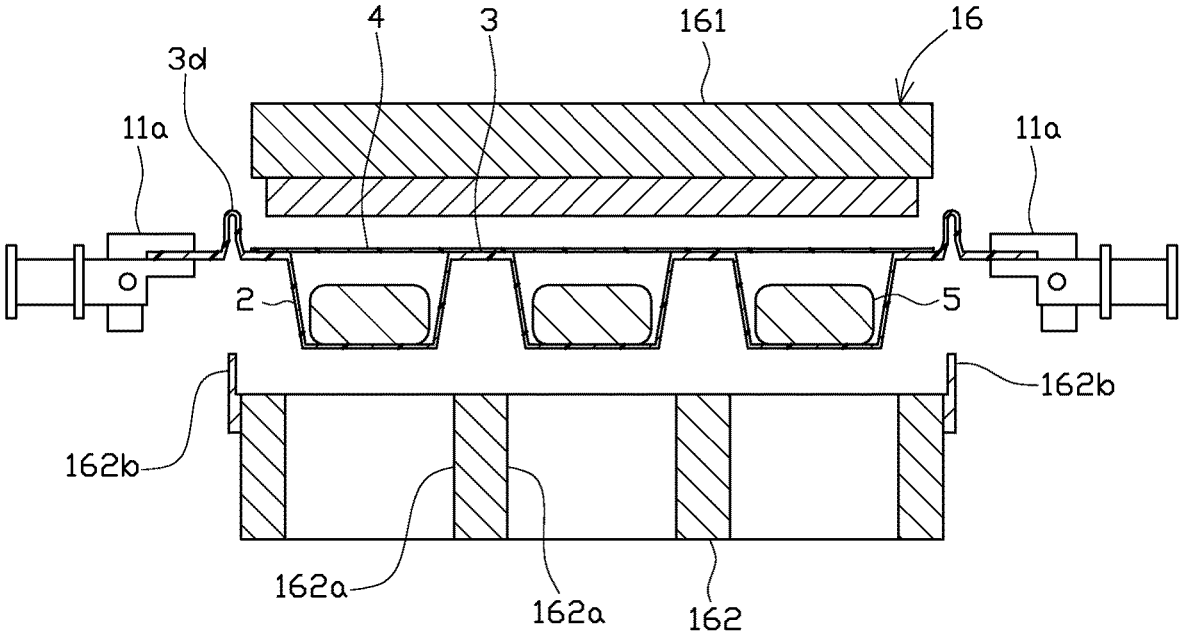
FIG. 10 is a schematic sectional view illustrating the schematic configuration of a sealing device.

As shown in FIG. 10, the upper sealing mold 161 is placed above the container film 3 and is configured to be vertically movable by a non-illustrated driving unit. A lower surface of the upper sealing mold 161 is configured to be heated to a predetermined sealing temperature by a non-illustrated heating unit and to be pressed against an upper surface of the lower sealing mold 162.

The lower sealing mold 162 is configured to be vertically movable by a non-illustrated driving unit and includes receiving recesses 162*a* provided to receive the pocket portions 2 therein. Positioning guides 162*b* that are protruded upward are formed on respective ends of the lower sealing mold 162 along the width direction of the container film 3. In the process of mounting the cover film 4 to the container film 3, the positioning guides 162*b* are placed in the protruding portions 3*d*, so as to position the container film 3 along the width direction thereof. The positioning guides 162*b* according to one or more embodiments are protrusions extended along the conveying direction of the container film 3. The positioning guide 162*b* may be configured by a plurality of protrusions provided at some intervals along the conveying direction.

Figure 14:
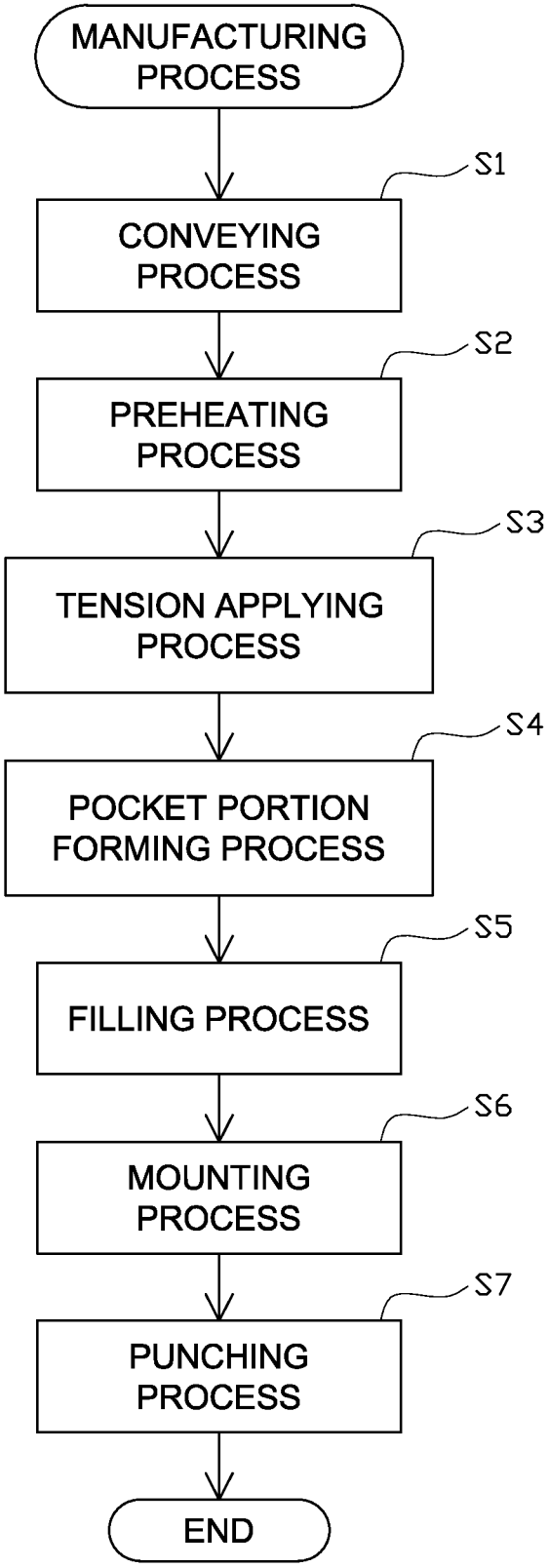
FIG. 14 is a flowchart showing a process of manufacturing the blister pack.

The following describes a manufacturing process of the blister pack 1 using the blister packing machine 10 with reference to the flowchart of FIG. 14.

As shown in FIG. 14, the manufacturing process of the blister pack 1 first performs a conveying process of step S1. The conveying process starts conveyance of the container film 3 by the clip chain conveyor 11. This causes the container film 3 to be gradually conveyed to downstream.

The manufacturing process subsequently performs a preheating process of step S2. The preheating process causes the preheating device 12 to preheat at least the pocket portion forming areas of the conveyed container film 3 where the pocket portions 2 are to be formed. The container film 3 is preheated to a relatively high temperature and is thus likely to sag (slack) (as shown in FIG. 5).

Figure 6:
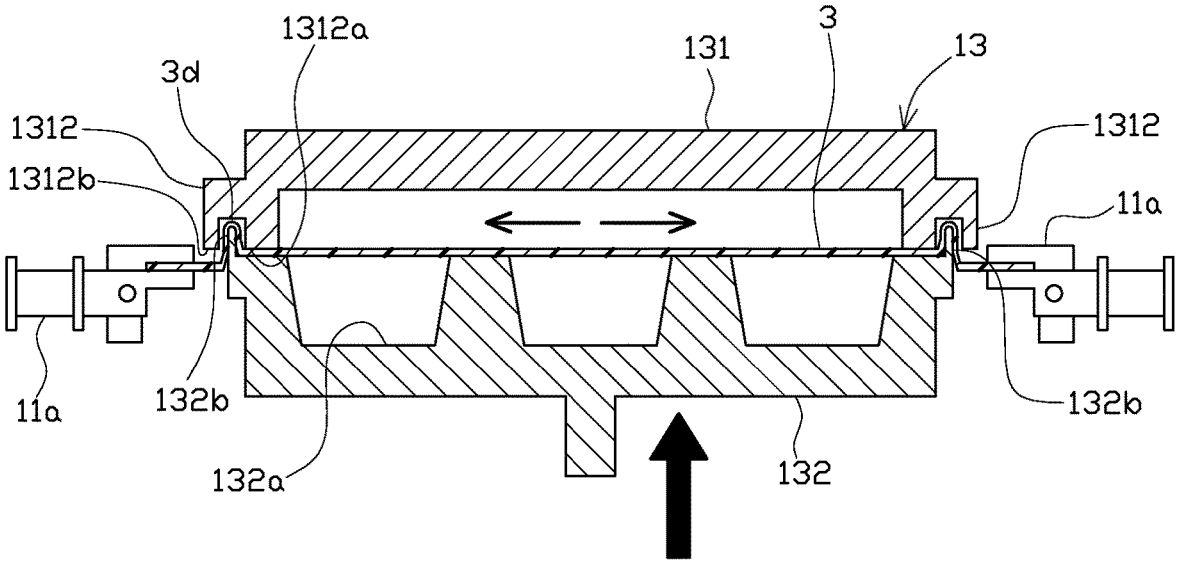
FIG. 6 is a schematic sectional view illustrating a container film which the tension is applied to by protruding portion forming elements.

The manufacturing process subsequently performs a tension applying process of step S3. In the tension applying process, the lower mold 132 placed at the retreat position described above is moved to the approach position described above. This causes the protruding portion forming elements 132*b* to be pressed against the edge areas 3*c* of the container film 3 and to form the protruding portions 3*d* that are protruded and deformed upward in the container film 3, so as to apply the tension along the width direction of the container film 3 to the container film 3 (as shown in FIG. 6). This strains the container film 3 that is made to sag (slack) by preheating.

When the edge areas 3*c* are pressed by the protruding portion forming elements 132*b*, the holding guides 1312 (the inner side holding element 1312*a* and the outer side holding element 1312*b*) are placed on respective sides of and adjacent to the protruding portion forming element 132*b* along the width direction and serve to hold an opposite surface of the container film 3 that is opposite to the pressed surface of the container film 3 pressed by the protruding portion forming element 132*b*. As a result, in the tension applying process, the container film 3 is pressed by the protruding portion forming elements 132*b*, while the holding guides 1312 work to hold the adjacent parts of the container film 3 that are adjacent to the pressed parts of the container film 3 pressed by the protruding portion forming elements 132*b*.

Figure 7:
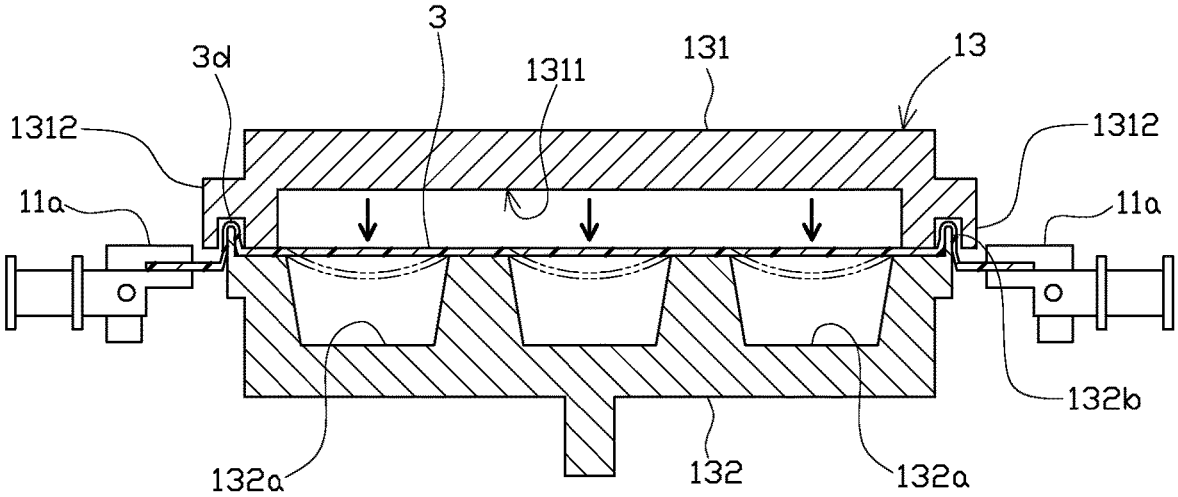
FIG. 7 is a schematic sectional view illustrating the container film deformed by supplying a gas.
Figure 8:
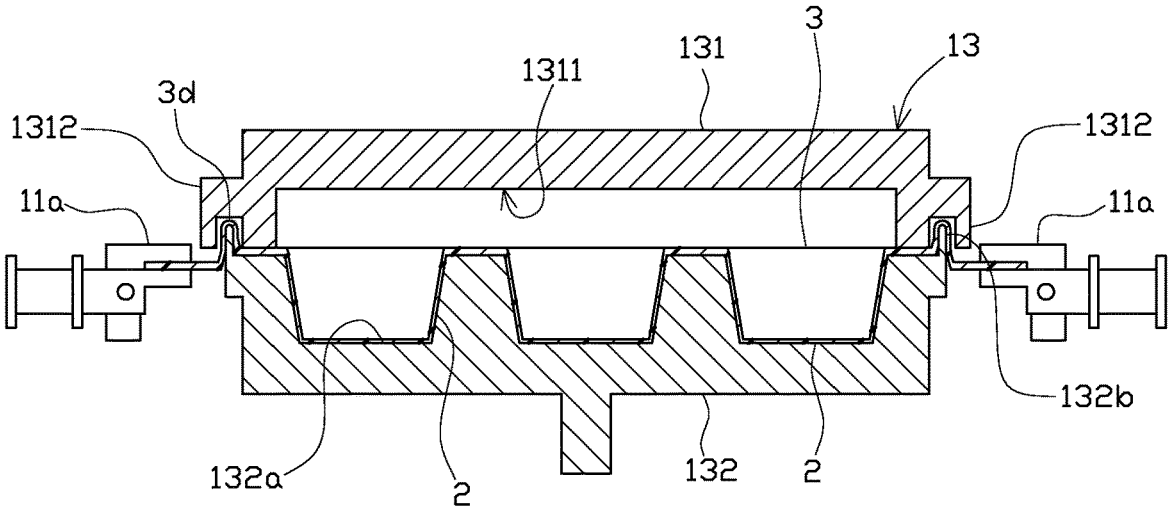
FIG. 8 is a schematic sectional view illustrating pocket portions formed by supplying the gas.
Figure 9:
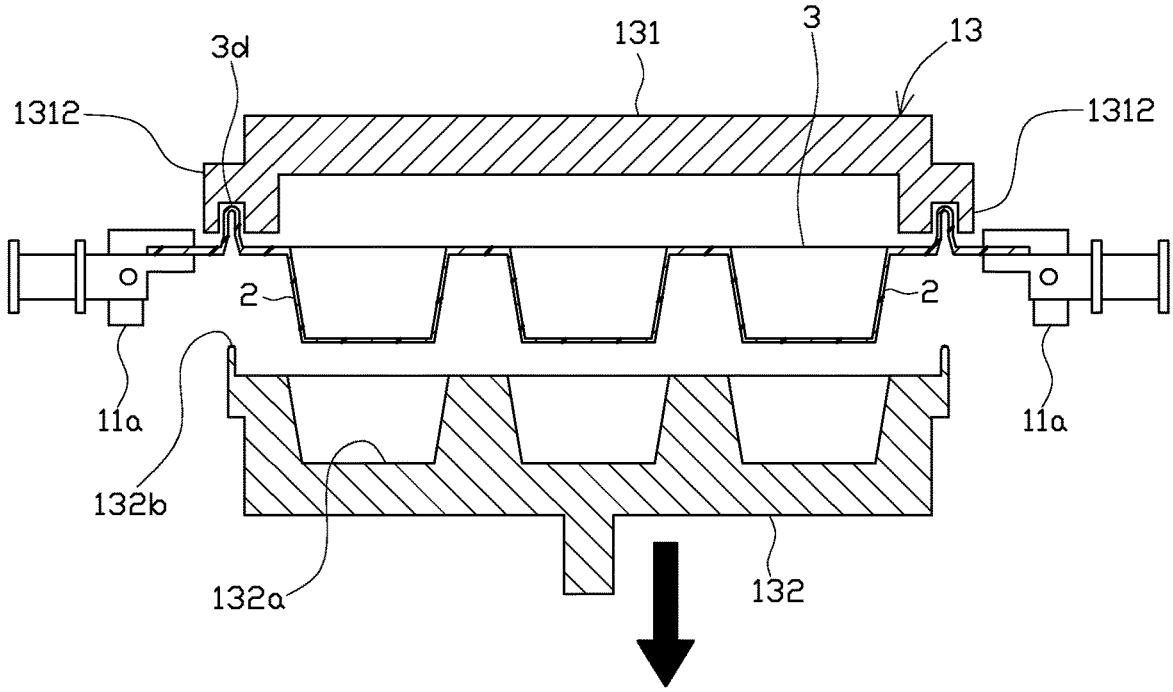
FIG. 9 is a schematic sectional view illustrating a lower mold moved to a retreat position.

The manufacturing process subsequently performs a pocket portion forming process of step S4. In the pocket portion forming process, the lower mold 132 is moved to the approach position described above, in the state that the tension is applied to the container film 3 by the tension applying process, so that the container film 3 is placed between the upper mold 131 and the lower mold 132 (as shown in FIG. 6). In this state, a gas is supplied into the internal space 1311 of the upper mold 131 described above to press the softened container film 3 against the molding recesses 132*a* of the lower mold 132 (as shown in FIG. 7: the flow of the gas is shown by thick arrows and the deformation of the container film 3 is shown by two-dot chain lines in FIG. 7). As a result, the pocket portions 2 are formed in the container film 3 (as shown in FIG. 8). The lower mold 132 is then moved to the retreat position described above to be returned to the state that does not interfere with the move of the container film 3 (as shown in FIG. 9).

In a filling process of subsequent step S5, the pocket portions 2 are filled with the content 5 by the filling device 14.

Figure 11:
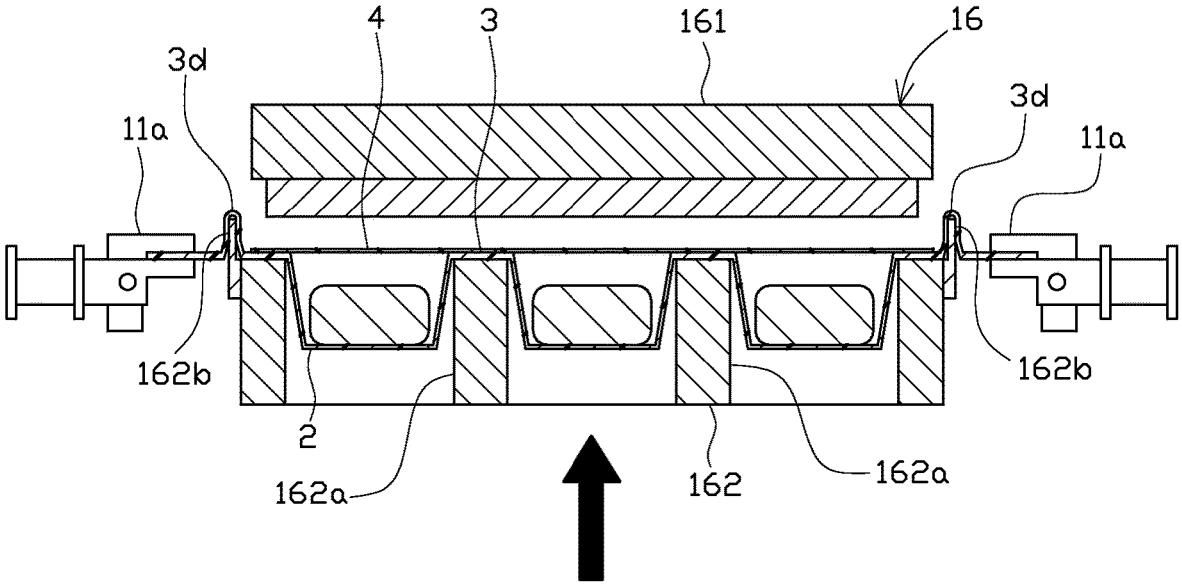
FIG. 11 is a schematic sectional view illustrating positioning guides placed in protruding portions.

The manufacturing process subsequently performs a mounting process of step S6. In the mounting process, the lower sealing mold 162 is moved upward, in the state that the container film 3 and the cover film 4 are fed in between the upper sealing mold 161 and the lower sealing mold 162 (in the state shown in FIG. 10), so that the pocket portions 2 are placed in the receiving recesses 162*a* and the positioning guides 162*b* are placed in the protruding portions 3*d* (as shown in FIG. 11). This configuration positions the container film 3 along the width direction of the container film 3 and suppresses swinging or shaking of the container film 3 caused by the presence of the protruding portions 3*d*.

Figure 12:
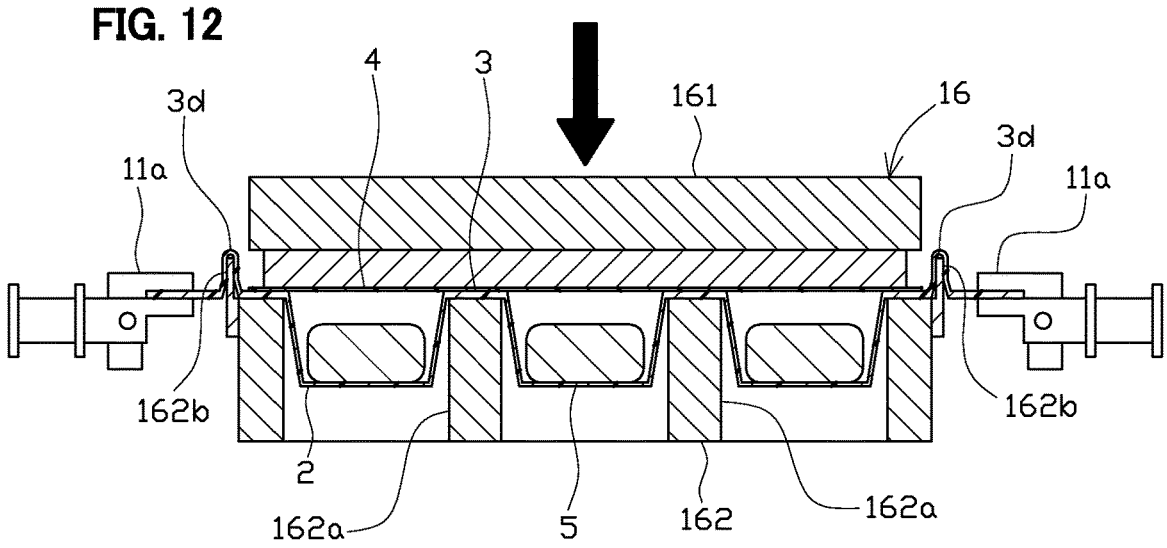
FIG. 12 is a schematic sectional view illustrating an upper sealing mold moved such that the container film and the like are placed between a lower sealing mold and the upper sealing mold.
Figure 13:
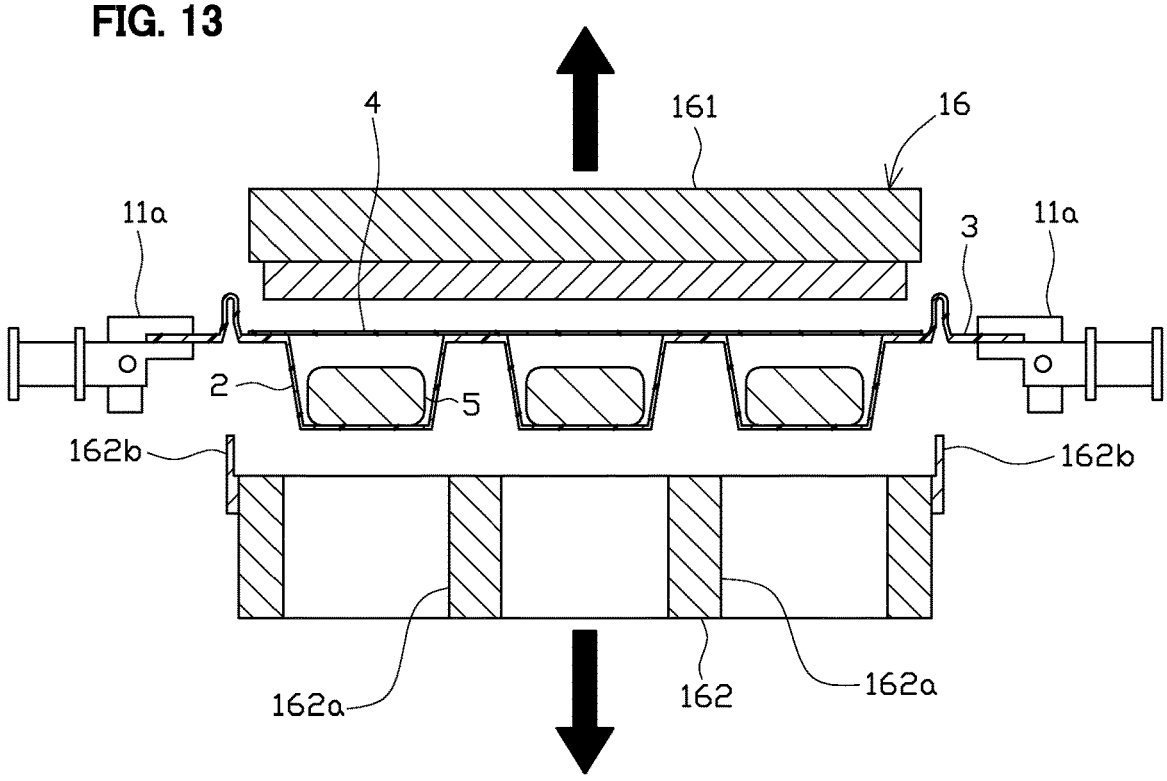
FIG. 13 is a schematic sectional view illustrating the upper sealing mold and the lower sealing mold returned to their original placement positions.

The upper sealing mold 161 with a heated lower surface is then moved downward, so that both the films 3 and 4 are placed between the upper sealing mold 161 and the lower sealing mold 162 (as shown in FIG. 12). As a result, this causes the cover film 4 to be welded to the container film 3 and obtains the blister film 6. After the welding, the respective molds 161 and 162 are moved in the directions respectively separating from the container film 3 to be returned to their original positions (as shown in FIG. 13).

The manufacturing process lastly performs a punching process of step S7. The punching process causes the punching device 17 to punch predetermined positions in the blister film 6, so as to obtain the blister packs 1.

As described above in detail, the configuration of one or more embodiments forms the pocket portions 2 in such a state that the tension along the width direction of the container film 3 is applied to at least the pocket portion forming areas of the container film 3 where the pocket portions 2 are to be formed. Accordingly, this configuration enables the pocket portions 2 to be formed, while stretching the container film 3 in the width direction thereof to effectively suppress the container film 3 from sagging, even when the preheating temperature of the container film 3 is a high temperature for the purpose of heat treatment such as retort sterilization. This more reliably prevents defects, such as, wrinkles arising in the pocket portions 2 or in the expected mounting part of the container film 3 where the cover film 4 is to be mounted to, in the course of forming the pocket portions 2.

More specifically, according to the configuration of one or more embodiments, the protruding portion forming elements 132*b* press and deform the edge areas 3*c* of the container film 3 to form the protruding portions 3*d*, so as to stably apply the tension to the container film 3. Accordingly, this relatively easily provides the configuration of stably applying the tension to the container film 3. As a result, this achieves simplification and downsizing of the apparatus and reduction of the cost involved in manufacture and maintenance of the apparatus.

Furthermore, when the protruding portion forming elements 132*b* press the edge areas 3*c*, the holding guides 1312 hold the adjacent parts of the container film 3 that are adjacent to the pressed parts of the container film 3 pressed by the protruding portion forming elements 132*b*, so as to prevent the adjacent parts from being moved with the motion of the protruding portion forming elements 132*b*. This enables the shape of the protruding portions 3*d* that are to be formed, to be effectively reformed along the surface configuration of the protruding portion forming elements 132*b* and enables the protruding portions 3*d* to be more stably kept in a fixed shape in a subsequent process. As a result, this reliably prevents the occurrence of a defect caused by the unstable shape of the protruding portions 3*d* (for example, a variation in the positions of the pocket portions 2 along the width direction or interference of the protruding portions 3*d* in a subsequent process).

Moreover, the upper mold 131 is provided with the holding guides 1312, and the lower mold 132 is provided with the protruding portion forming elements 132*b*. This configuration suppresses an increase in the total number of components constituting the blister packing machine 10, while providing the protruding portion forming elements 132*b* and the holding guides 1312. The container film 3 is pressed by the protruding portion forming elements 132*b* simply by moving the lower mold 132. This configuration does not need to provide any driving source for operating the protruding portion forming elements 132*b*, separately from a driving source (driving unit) for operating the lower mold 132.

Furthermore, in the process of mounting the cover film 4 to the container film 3, the protruding portions 3*d* formed to apply the tension are effectively used for positioning by the positioning guides 162*b*. This configuration enables the cover film 4 to be mounted to the container film 3 that is accurately positioned in the width direction thereof. This ensures the more appropriate mounting process of the cover film 4 to the container film.

Additionally, the configuration of one or more embodiments uses the wide container film 3 that enables a plurality of the pocket portions 2 to be formed along the width direction. This enables the plurality of pocket portions 2 to be formed simultaneously and enhances the production efficiency.

The present disclosure is not limited to the description of the above embodiments but may be implemented, for example, by configurations described below. The present disclosure may also be naturally implemented by applications and modifications other than those illustrated below.

Figure 15:
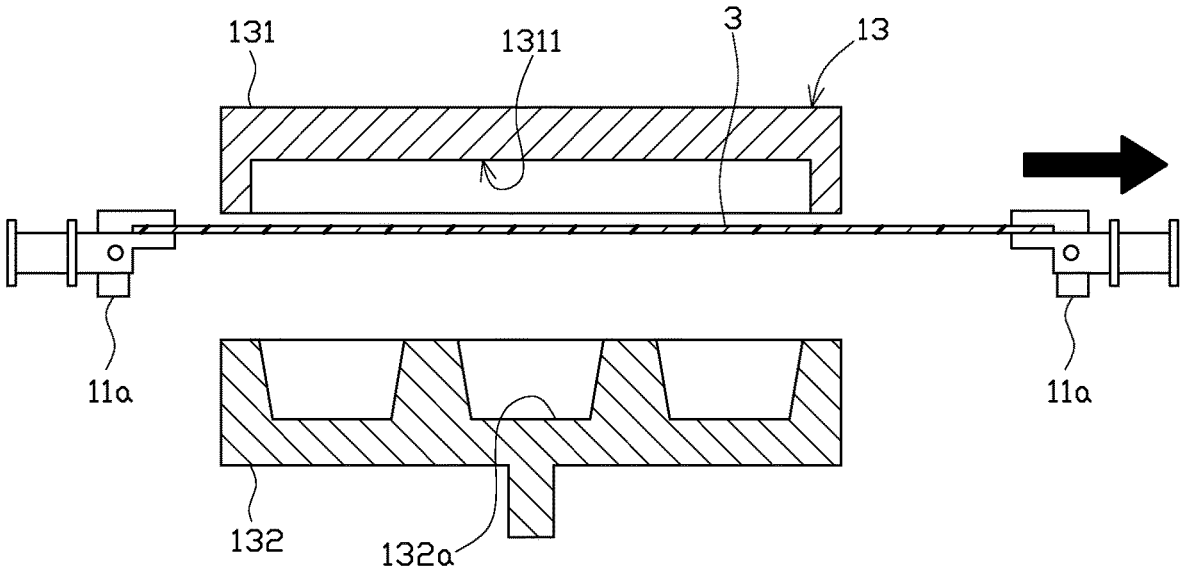
FIG. 15 is a schematic sectional view illustrating clip portions configured to apply the tension to the container film according to another example of one or more embodiments.
Figure 16:
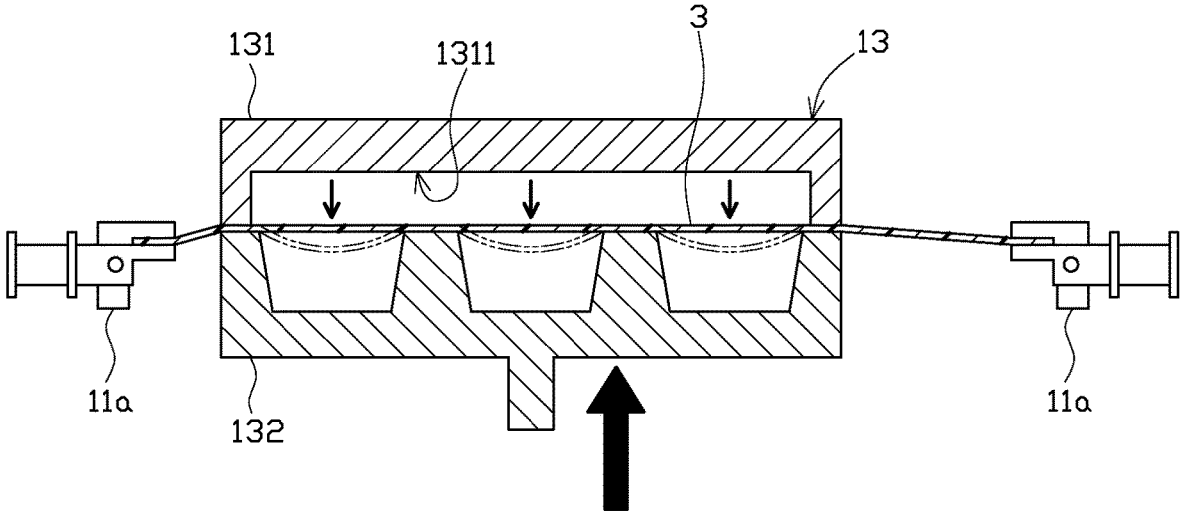
FIG. 16 is a schematic sectional view illustrating a pocket portion forming device configured to place therein the container film under application of the tension according to another example of one or more embodiments.

(a) According to the above embodiments, the protruding portion forming elements 132*b* are configured to press the container film 3 and form the protruding portions 3*d*, so as to apply the tension to the container film 3. As shown in FIG. 15, according to a modification, however, the clip portions 11*a* may be configured to be movable along the width direction of the container film 3 and to be moved to apply the tension along the width direction of the container film 3 (tensile force in a direction of stretching the container film 3 in the width direction thereof) to the container film 3. The tension applying portion may thus be provided with a "film moving element" that corresponds to the clip portion 11*a* described above and that is configured to hold an end in the width direction of the container film 3 and to be movable along the width direction of the container film 3. In this modification, in the state that the tension is applied to the container film 3 to stretch the container film 3 by moving the film moving elements (the clip portions 11*a*), the container film 3 is placed between the upper mold 131 and the lower mold 132 as shown in FIG. 16. This modification subsequently supplies the gas into the internal space 1311 to form the pocket portions 2.

This modification of applying the tension to the container film 3 may be configured to move only the film moving element (the clip portion 11*a*) located at one end in the width direction of the container film 3 or may be configured to move the respective film moving elements (the clip portions 11*a*) located at the respective ends in the width direction of the container film 3.

(b) According to the embodiments described above, the sealing device 16 configures the processing unit and is provided with the positioning guides 162*b*. The processing unit provided with the positioning guides is, however, not limited to the sealing device.

Figure 17:
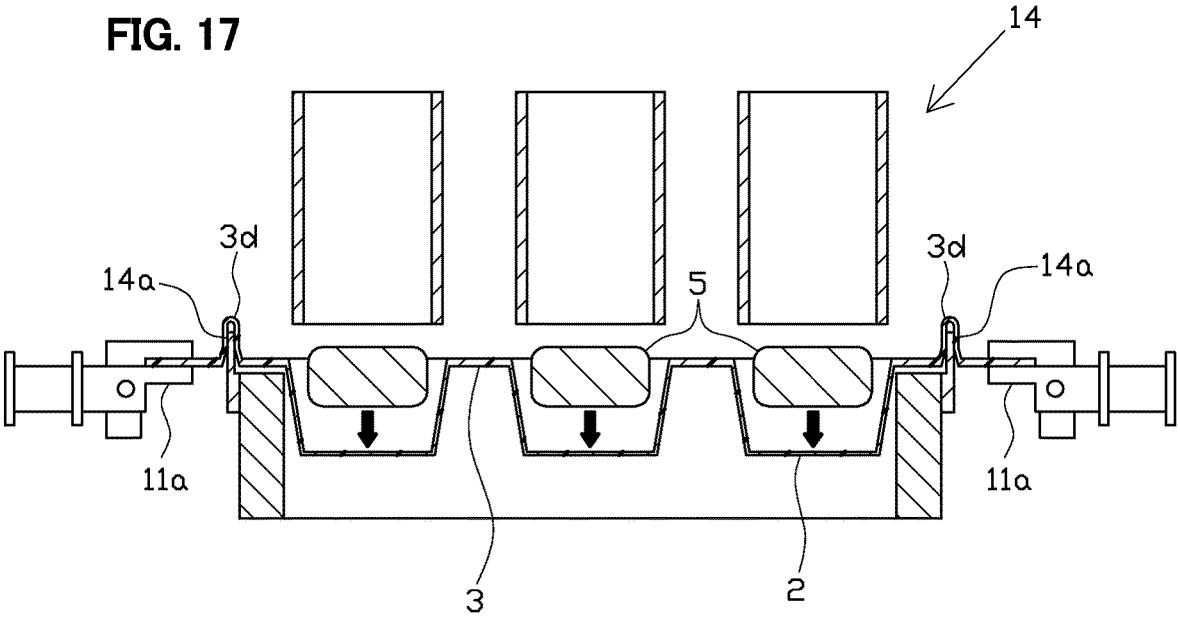
FIG. 17 is a schematic sectional view illustrating a filling device provided with positioning guides according to another example of one or more embodiments.

For example, as shown in FIG. 17, the filling device 14 may configure the processing unit and may be provided with positioning guides 14*a*. This modified configuration more accurately fills the pocket portions 2 with the content 5.

Figure 18:
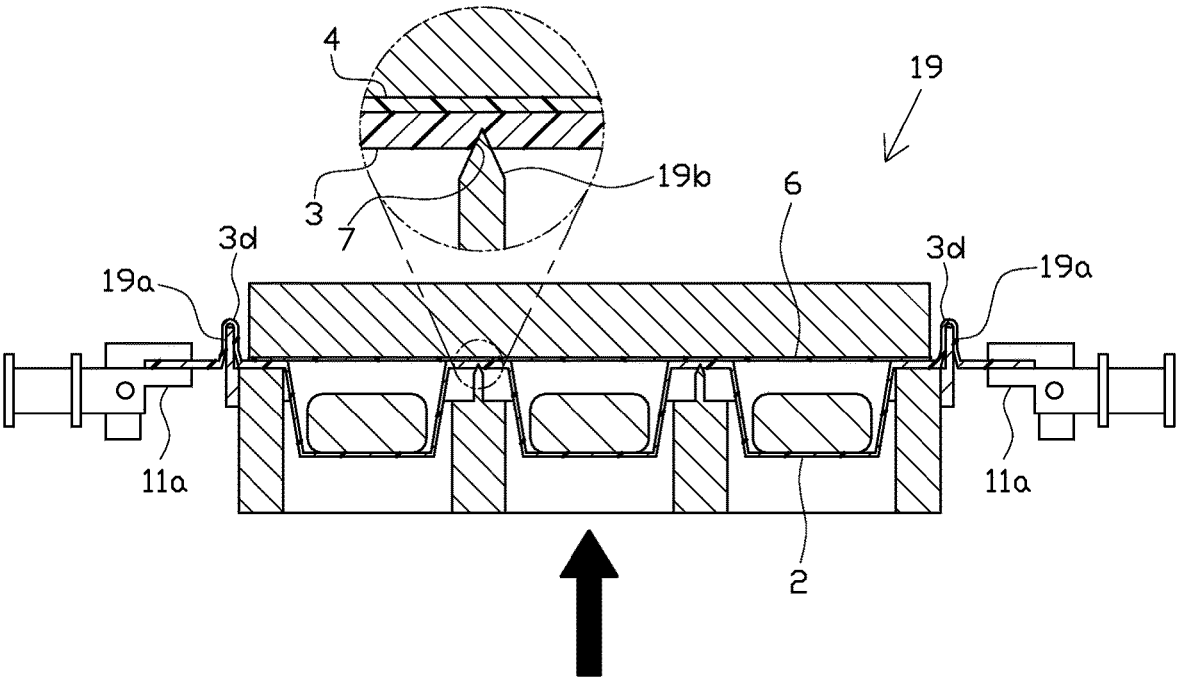
FIG. 18 is a schematic sectional view illustrating a cutting part forming device provided with positioning guides according to another example of one or more embodiments.

In another example, as shown in FIG. 18, a cutting part forming device 19 that is provided with a predetermined cutting edge 19*b* and that serves as the processing unit may be placed between the sealing device 16 and the punching device 17 to form cutting parts 7, for example, slits or perforations, for separating blister packs, in the blister film 6 by the cutting edge 19*b*, and may be provided with positioning guides 19*a*. This modified configuration forms the separating parts 7 in the blister film 6 with the higher accuracy. In the case of forming the cutting parts 7, the blister pack 1 generally has a plurality of pocket portions 2.

Figure 19:
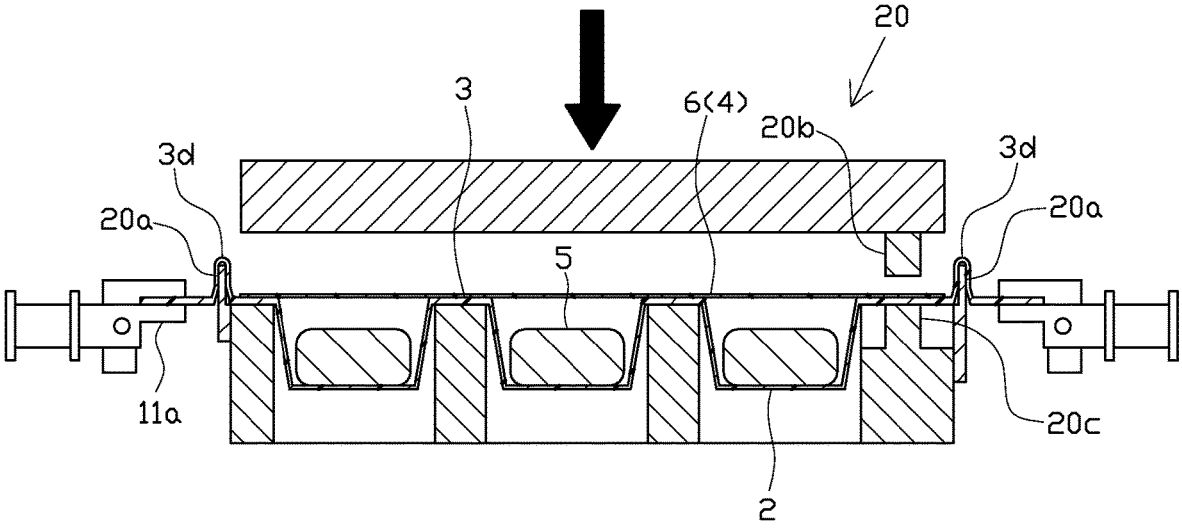
FIG. 19 is a schematic sectional view illustrating a stamping device provided with positioning guides according to another example of one or more embodiments.

Furthermore, in another example, as shown in FIG. 19, a stamping device 20 that is provided with a pressurizing portion 20*b* configured to form a stamp indicating predetermined information and with a pressure-receiving portion 20*c* configured to receive the pressurizing portion 20*b* and that serves as the processing unit to form a stamp in the blister film 6 by these portions such as the pressurizing portion 20*b* may be placed between the sealing device 16 and the punching device 17 and may be provided with positioning guides 20*a*. This modified configuration enables the stamp to be more accurately formed in the blister film 6.

Figure 20:
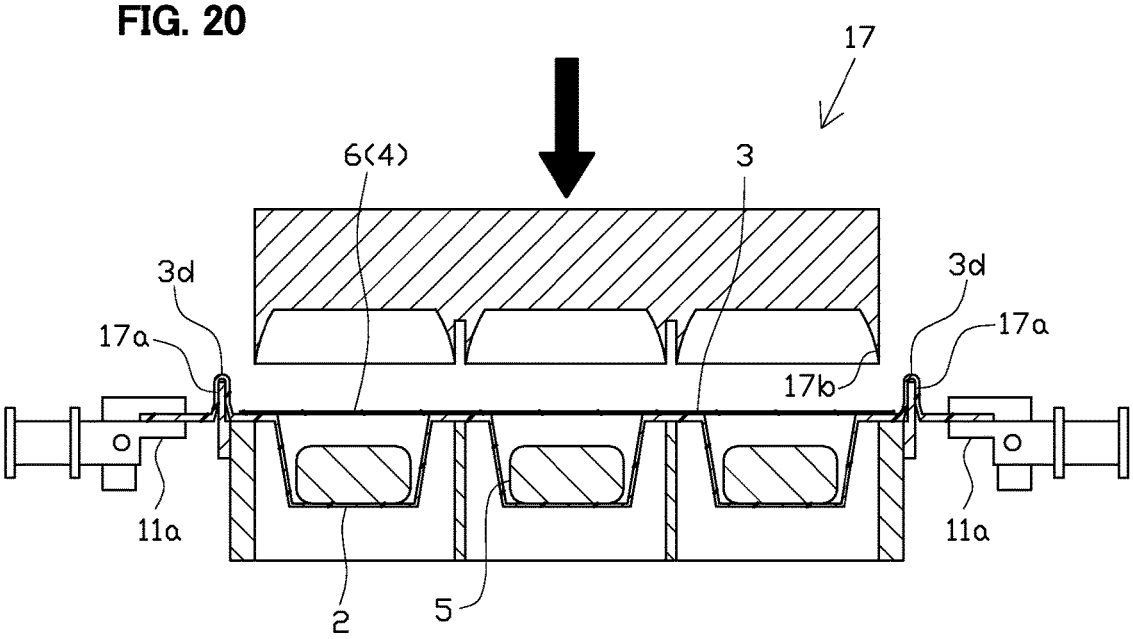
FIG. 20 is a schematic sectional view illustrating a punching device provided with positioning guides according to another example of one or more embodiments.

Additionally, in another example, as shown in FIG. 20, the punching device 17 provided with a predetermined punching edge 17*b* may be configured as the processing unit and may be provided with positioning guides 17*a*. This modified configuration enables target locations in the blister film 6 to be punched out more accurately and thereby enables the shapes of the blister packs 1 to be a fixed shape more stably.

In the above examples, the positioning guides are formed to be received in the protruding portions 3*d*. According to a modification, however, the positioning guides may be formed in a concave shape, and the protruding portions 3*d* may be formed to be received in the concave shape of the positioning guides, so as to position (align) the container film 3 or the blister film 6.

(c) According to the embodiments described above, one protruding portion forming element 132*b* is provided at each of the respective ends of the lower mold 132 along the width direction of the container film 3.

According to a modification, however, a plurality of the protruding portion forming elements 132*b* may be provided at each of the respective ends of the lower mold 132. According to another modification, the protruding portion forming element 132*b* may be provided at only one end of the lower mold 132.

(d) According to the embodiments described above, the protruding portion 3*d* is protruded upward. The protruding portion may, however, be protruded downward. In this modification, the upper mold 131 may be configured to be vertically movable and may be provided with protruding portion forming elements that are protruded downward. The upper mold 131 may be moved downward to press the container film 3 and form the protruding portions.

(e) The above embodiments are provided with the holding guides 1312 and the positioning guides 162*b*. A modification may not be provided with the holding guides or the positioning guides. The configuration of the holding guides and the positioning guides may be changed appropriately according to a change in configuration of the protruding portion forming elements.

(f) According to the embodiments described above, the protruding portion forming elements 132*b* are provided on the lower mold 132, and the holding guides 1312 are provided on the upper mold 131. The protruding portion forming elements and the holding guides may be provided separately from the upper mold 131 and the lower mold 132. The protruding portion forming elements may be configured to move independently of the pocket portion forming device 13.

(g) A support belt may be provided in at least a location between the preheating device 12 and a downstream side of the pocket portion forming device 13 to move synchronously with the container film 3 conveyed by the clip chain conveyor 11, while supporting a region of the container film 3 other than the pocket portions 2 or a region of the container film 3 other than the pocket portion forming areas where the pocket portions 2 are to be formed. In this configuration, the support belt serves to more effectively suppress the sag of the container film 3 caused by preheating and to more reliably prevent the defects, such as wrinkles arising due to a sag of the container film 3. When the tension is applied to the container film 3 by the pressure generated by the protruding portion forming elements 132*b*, the support belt may be provided to support a remaining region of the container film 3 other than the locations pressed by the protruding portion forming elements 132*b*.

(h) According to the embodiments described above, the preheating device 12 and the pocket portion forming device 13 are provided separately. These components may, however, be integrated with each other. More specifically, a preheating forming device having the function of preheating the container film 3 and the function of forming the pocket portions 2 may be provided in place of the preheating device 12 and the pocket portion forming device 13. In this case, the preheating unit and the pocket portion forming unit are configured by the preheating forming device.

(i) According to the embodiments described above, the pocket portions 2 are formed by the pressure forming method. A modification may be configured to form the pocket portions 2 by vacuum forming method or any other forming method.

According to the embodiments described above, the pocket portion forming device 13 is configured to form one line of pocket portions 2 arrayed in the width direction of the container film 3. According to a modification, the pocket portion forming device 13 may be configured to form multiple lines of pocket portions 2 simultaneously.

(j) According to the embodiments described above, the blister pack 1 is configured to have one pocket portion 2. The number of the pocket portions 2 provided in the blister pack 1 is, however, not limited to the above embodiments, but the blister pack 1 employed may have any number of pocket portions 2. In other words, the technical concept of the present disclosure may be applied to a blister pack having a plurality of pocket portions 2 and a manufacturing method of such a blister pack. The shape of the pocket portion 2 may also be changed, altered or modified appropriately.

According to the embodiments described above, the blister pack 1 is not provided with the protruding portion 3*d*. According to a modification, however, the blister pack 1 may be provided with the protruding portion 3*d*. This modified configuration enhances the strength of the blister pack 1 by the presence of the protruding portion 3*d*.

Furthermore, according to the embodiments described above, the blister film 6 is configured to have a plurality of pocket portions 2 along the width direction thereof. This configuration is, however, not essential. According to a modification, the blister film 6 may be configured to have only one pocket portion 2 along the width direction thereof.

(k) According to the embodiments described above, the tension applying portions (the protruding portion forming elements 132*b*) are provided corresponding to the edges in the width direction of the container film 3. The locations of the tension applying portions are not necessarily limited to the edges. For example, according to a modified configuration, the tension applying portions (for example, the protruding portion forming elements 132*b*) may be provided in every array or in every plural arrays of pocket portion forming areas where the pocket portions 2 are to be formed.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 . . . blister pack, 2 . . . pocket portion, 3 . . . container film, 3*c* . . . edge area, 3*d* . . . protruding portion, 4 . . . cover film, 5 . . . content, 6 . . . blister film, 10 . . . blister packing machine, 11 . . . clip chain conveyor (conveying unit), 12 . . . preheating device (preheating unit), 13 . . . pocket portion forming device (pocket portion forming unit), 16 . . . sealing device (processing unit), 131 . . . upper mold, 132 . . . lower mold, 132*b* . . . protruding portion forming element (tension applying portion), 162*b* . . . positioning guide, 1312 . . . holding guide

The invention claimed is:

1. A blister packing machine for manufacturing a blister pack, comprising:

a conveyor that conveys a belt-like container film having a pocket portion forming area where a pocket portion is formed and an expected mounting part where a cover film is mounted to close the pocket portion;

a preheating device that preheats the container film conveyed by the conveyor;

a pocket portion forming device that forms the pocket portion in the container film softened by the preheating device; and a tension applier that applies a tension along a width direction of the container film to at least the pocket portion forming area, wherein the pocket portion forming device forms the pocket portion while the tension applier applies the tension to the container film, the container film has an edge area between an edge in the width direction and the expected mounting part, and the tension applier comprises a projection that applies the tension to the container film by pressing the edge area to protrude and deform the edge area and form a protruding portion in the container film.

2. The blister packing machine according to claim 1, further comprising:

holding guides that:

are disposed on both sides of the projection along the width direction and adjacent to the projection, and hold a first surface of the container film opposite to a second surface of the container film pressed by the projection.

3. The blister packing machine according to claim 2, wherein the pocket portion forming device comprises:

a lower mold that is vertically movable; and an upper mold disposed above the lower mold, the projection is disposed in the lower mold, and the holding guides are disposed in the upper mold.

4. The blister packing machine according to claim 3, further comprising:

a processing device that executes predetermined processing to the container film or to a belt-like blister film obtained by mounting the cover film on the container film; and a positioning guide that positions, with the protruding portion, the container film or the blister film along the width direction during the predetermined processing.

5. The blister packing machine according to claim 4, wherein the container film has a plurality of pocket portions including the pocket portion that are disposed along the width direction.

6. The blister packing machine according to claim 3, wherein the container film has a plurality of pocket portions including the pocket portion that are disposed along the width direction.

7. The blister packing machine according to claim 2, further comprising:

a processing device that executes predetermined processing to the container film or to a belt-like blister film obtained by mounting the cover film on the container film; and a positioning guide that positions, with the protruding portion, the container film or the blister film along the width direction during the predetermined processing.

8. The blister packing machine according to claim 7, wherein the container film has a plurality of pocket portions including the pocket portion that are disposed along the width direction.

9. The blister packing machine according to claim 2, wherein the container film has a plurality of the pocket portions formed along the width direction.

10. The blister packing machine according to claim 1, further comprising:

a processing device that executes predetermined processing to the container film or to a belt-like blister film obtained by mounting the cover film on the container film; and a positioning guide that positions, with the protruding portion, the container film or the blister film along the width direction during the predetermined processing.

11. The blister packing machine according to claim 10, wherein the container film has a plurality of pocket portions including the pocket portion that are disposed along the width direction.

12. The blister packing machine according to claim 1, wherein the container film has a plurality of the pocket portions formed along the width direction.

13. A blister pack manufacturing method, comprising:

conveying a belt-like container film having a pocket portion forming area where a pocket portion is formed and an expected mounting part where a cover film is mounted to close the pocket portion;

preheating the container film conveyed in the conveying;

forming the pocket portion in the container film softened in the preheating; and applying a tension along a width direction of the container film to at least the pocket portion forming area, wherein the forming is performed while applying the tension to the container film, the container film has an edge area between an edge in the width direction and the expected mounting part, and the applying applies the tension to the container film by pressing the edge area to protrude the edge area and form a protruding portion in the container film.

* * * * *